US005943034A

United States Patent [19]

Adachi

[11] Patent Number: 5,943,034

[45] Date of Patent: Aug. 24, 1999

[54] METHOD FOR DRIVING A DISPLAY DEVICE

[75] Inventor: Masahiro Adachi, Nara, Japan

[73] Assignee: Sharp Kabushiki Kaisha, Osaka, Japan

[21] Appl. No.: 08/575,882

[22] Filed: Dec. 20, 1995

[30] Foreign Application Priority Data

Dec. 22, 1994 [JP] Japan ..... 6-320785

[51] Int. Cl.[6] ..... G09G 3/36

[52] U.S. Cl. ..... 345/94; 345/87; 345/99

[58] Field of Search ..... 345/94, 87, 90, 345/99, 92, 55, 208; 348/790, 792; 349/33, 41, 42

[56] References Cited

U.S. PATENT DOCUMENTS 5,594,464 1/1997 Tanaka et al. ..... 345/94

FOREIGN PATENT DOCUMENTS 05100636 4/1993 Japan .

05204331 8/1993 Japan .

05204337 8/1993 Japan .

*Primary Examiner*—Dennis-Doon Chow

*Attorney, Agent, or Firm*—Nixon & Vanderhye P.C.

[57] ABSTRACT

The method for driving a display apparatus including a plurality of pixel electrodes; a plurality of thin film transistors each connected to a corresponding pixel electrode, a plurality of gate lines for applying a gate signal to the corresponding pixel electrode; and a plurality of data lines for applying a data signal to the corresponding pixel electrode via the thin film transistor, the method including the steps of: applying a gate signal to the gate line, the gate signal including an on-pulse which defines a period during which the corresponding thin film transistor is turned on; and applying a data signal to the data line, the data signal including an image signal portion which defines a voltage level of an image display, wherein a ratio of a period of the image signal portion of the data signal to a period of the on-pulse of the gate signal is set to approximately 80% or less.

14 Claims, 6 Drawing Sheets

METHOD FOR DRIVING A DISPLAY DEVICE

BACKGROUND OF THE INVENTION

1. Field of the Invention

The present invention relates to a method for driving a display device. More specifically, the present invention relates to a method for driving a liquid crystal display device using high-speed write type thin film transistors having a carrier mobility of 1 $cm^2/V \cdot S$ or more, and preferably 10 $cm^2/V \cdot S$ or more. Hereinafter, such a liquid crystal display device is referred to as a TFT-LCD.

2. Description of the Related Art

FIG. 4 schematically shows the configuration of a TFT-LCD. Referring to FIG. 4, a plurality of pixel electrodes 41 are arranged in a matrix on an insulating substrate 40. A plurality of gate lines 43 and a plurality of data lines 44 are arranged on the insulating substrate 40, running in a row direction and a column direction, respectively, between adjacent pixel electrodes 41. A thin film transistor 42 (hereinafter, referred to as a TFT) is arranged at each crossing of the gate lines 43 and the data lines 44. A drain electrode 42*a* of the TFT 42 is connected to the corresponding pixel electrode 41. A gate electrode 42*b* of the TFT 42 is connected to the corresponding gate line 43, while a source electrode 42*c* thereof is connected to the corresponding data line 44. A counter electrode (not shown) is disposed above the pixel electrodes 41 via a liquid crystal layer so as to oppose the pixel electrodes 41. A voltage is applied between the pixel electrodes and the counter electrode so as to change the orientation of liquid crystal molecules in the liquid crystal layer. By controlling the voltage to be applied between the respective pixel electrodes and the counter electrode, image display is performed by use of a change of the optical characteristic of the liquid crystal layer due to the change of the orientation of the liquid crystal molecules.

A method for driving a TFT-LCD with the above configuration is disclosed, for example, in Japanese Laid-Open Patent Publication No. 60-59389. Such method will be described as follows with reference to FIG. 5.

Pulsing scanning signals 51 are sequentially applied to the gate lines 43, while an image signal 52 is input to the data lines 44 in synchronization with the pulsing of the scanning signals 51. The TFTs 42 are of an n-channel type in this example. Thus, when the scanning signal 51 is at the HIGH level, the channel of each of the corresponding TFTs 42 is activated (ON state), allowing the corresponding pixel electrode 41 and the corresponding data line 44 to be electorically conected. At the time when the scanning signal 51 becomes the HIGH level, the data line 44 is supplied with a desired image voltage by the image signal 52.

With a current technical trend in TFT-LCDs for improving the resolution of the screen, efforts for reducing the size of TFTs and improving the performance of TFTs have been made. Conventionally, most commercialized TFT-LCDs use amorphous silicon as the semiconductor material. Recently, however, in order to increase the speed of charging loads and improve the resolution of the screen, non-amorphous silicon which has higher crystallinity than the amorphous silicon, such as polysilicon and micro-crystalline silicon, has been used increasingly as the material for a semiconductor layer constituting the TFT. Incidentally, other current technical trends for reducing the size of the TFTs include reducing the gate length and thinning a gate insulating film.

The above trends involving TFT-LCDs leads to the necessity of reducing the voltage applied to the TFTs. More specifically, the use of a semiconductor material having a higher mobility than amorphous silicon, such as polysilicon, is advantageous in that the ON current of the TFT, i.e., the current which flows when the TFT is in the ON state, is large and the load charging speed increases. However, it is disadvantageous in that the OFF current of the TFT, i.e., the leak current which flows when the TFT is in the OFF state, is also large. As shown in FIG. 6, the OFF current decreases as the voltage applied between the source and drain of the TFT decreases. Thus, reducing the voltage applied to the TFT is required.

Reducing the gate length of the TFT and thinning the gate insulating film result in increasing the strength of an electric field applied to the TFT. This causes intrusion of carriers into the insulating film and resultant insulation breakdown. Thus, the reliability of the TFT is lost. These problems arising from the increase in the strength of the electric field can be minimized by reducing the voltage applied between the source and drain of the TFT. Thus, reducing the voltage applied to the TFT is also required from the aspect of the reliability of the TFT.

Further, it is known that the orientation of liquid crystal molecules at the edge portions of the pixel electrodes is disturbed due to a potential difference between the pixel electrodes and the bus lines for the source electrodes and the gate electrodes, i.e., the data lines and the gate lines, causing a defective display. Japanese Laid-Open Patent Publication No. 4-323624, for example, describes this display defect as a prior art problem. This display defect can be overcome by reducing the voltage to be applied between the source and drain of the TFT. Thus, reducing the voltage applied to the TFT is also required from the aspect of the display quality in relation to the liquid crystal.

SUMMARY OF THE INVENTION

The method for driving a display apparatus including a plurality of pixel electrodes; a plurality of thin film transistors each connected to a corresponding pixel electrode, a plurality of gate lines for applying a gate signal to the corresponding pixel electrode; and a plurality of data lines for applying a data signal to the corresponding pixel electrode via the thin film transistor of this invention includes the steps of: applying a gate signal to the gate line, the gate signal including an on-pulse which defines a period during which the corresponding thin film transistor is turned on; and applying a data signal to the data line, the data signal including an image signal portion which defines a voltage level of an image display, wherein a ratio of a period of the image signal portion of the data signal to a period of the on-pulse of the gate signal is set to approximately 80% or less.

Alternatively, a method for driving a display apparatus including a plurality of pixel electrodes; a plurality of thin film transistors each connected to a corresponding pixel electrode, a plurality of gate lines for applying a gate signal to the corresponding pixel electrode; and a plurality of data lines for applying a data signal to the corresponding pixel electrode via the thin film transistor is provided. The method includes the steps of: applying an gate signal to the gate line, the gate signal including a on-pulse which defines a period during which the corresponding thin film transistor is turned on; and applying a data signal to the data line, the data signal including an image signal portion which defines a voltage level of an image display and a non-image signal portion which does not define a voltage level of an image display, wherein, during a period of the on-pulse of the gate signal, a period of the image signal portion of the data signal is shorter than that of the non-image signal portion of the data signal.

In one embodiment, the on-pulse of the gate signal is changed from an on-level to an off-level during the period of the image signal portion of the data signal, the image signal portion of the data signal has a voltage level for an image display during a first period prior to the timing of changing from an on-level to an off-level of the on-pulse of the gate signal, and the non-image signal portion of the data signal has a constant value during a second period prior to the first period.

In another embodiment, the constant value of the non-image signal portion is a mean value between a minimum value and a maximum value of the image signal portion.

In still another embodiment, there is a temporal gap between the on-pulse applied to the gate line and a subsequent on-pulse applied to another gate line adjacent to the gate line, the temporal gap is at least 1 $\mu$S.

In still another embodiment, the thin film transistor has a mobility of 1 $cm^2/V \cdot S$ or more.

In still another embodiment, the thin film transistor includes a semiconductor layer which is made of polysilicon or micro-crystalline silicon.

In still another embodiment, the display apparatus includes a liquid crystal layer having a saturated voltage of 4 V or less as photoelectric characteristics of the liquid crystal layer.

Thus, according to the present invention, a data signal is applied, as an input signal, to the data line connected to the pixel electrode via the TFT. The data signal includes an image signal portion which defines a voltage level of image display. The ratio of a period of the image signal portion included in the data signal with respect to an on-pulse period of the scanning signal is set to approximately 80% or less. This reduces the effective value of the voltage which is applied between the source and drain of the TFT connected between the pixel electrode and the data line.

As a result, even when the TFT is made of a semiconductor material having a larger mobility than amorphous silicon, such as polysilicon, the increase of the OFF current of the TFT can be restrained. Thus, while restraining the increase of the OFF current of the TFT, a speed for charging the load can be improved due to the increase of the ON current of the TFT.

Further, the strength of the electric field applied to the TFT is substantially reduced. Thus, while the intrusion of carriers into the gate insulating film and the resultant insulation breakdown are minimized, the gate length of the TFT can be reduced and the gate insulating film can be thinned.

Moreover, due to the substantial reduction of the voltage applied to the TFT, the disorder of the orientation of liquid crystal molecules at the edge portions of the pixel electrodes caused by a potential difference between the bus lines and the pixel electrodes can be minimized. This improves the display characteristics of the liquid crystal display device and ensures long-term reliability.

According to the present invention, a data signal is applied, as an input signal, to the data line connected to the pixel electrode via the TFT. The data signal includes an image signal portion which defines a voltage level of an image display and a non-image signal portion which does not define any voltage level of an image display. During an on-pulse period of the scanning signal, a period of the image signal portion of the data signal is shorter than that of the non-image signal portion of the data signal. This reduces the effective value of the voltage applied to the TFT.

The voltage level of the non-image signal portion of the data signal is constant. The constant voltage is set at substantially the mean value of the maximum and minimum voltage levels of the image signal portions of the data signal. Thus, the voltage applied to the TFTs connected to the pixel electrodes can be reduced while the variation in the voltage is minimized.

Thus, the invention described herein makes possible the advantage of providing a method for driving a display device capable of reducing a voltage applied between the source and drain of a TFT which is connected to a pixel electrode and a data line, so as to reduce the OFF current of the TFT, improve the reliability of the TFT, and prevent inferior orientation of liquid crystal molecules, and thereby to improve further the display characteristics and the long-term reliability of the display device.

These and other advantages of the present invention will become apparent to those skilled in the art upon reading and understanding the following detailed description with reference to the accompanying figures.

DESCRIPTION OF THE PREFERRED EMBODIMENTS

Figure 1:
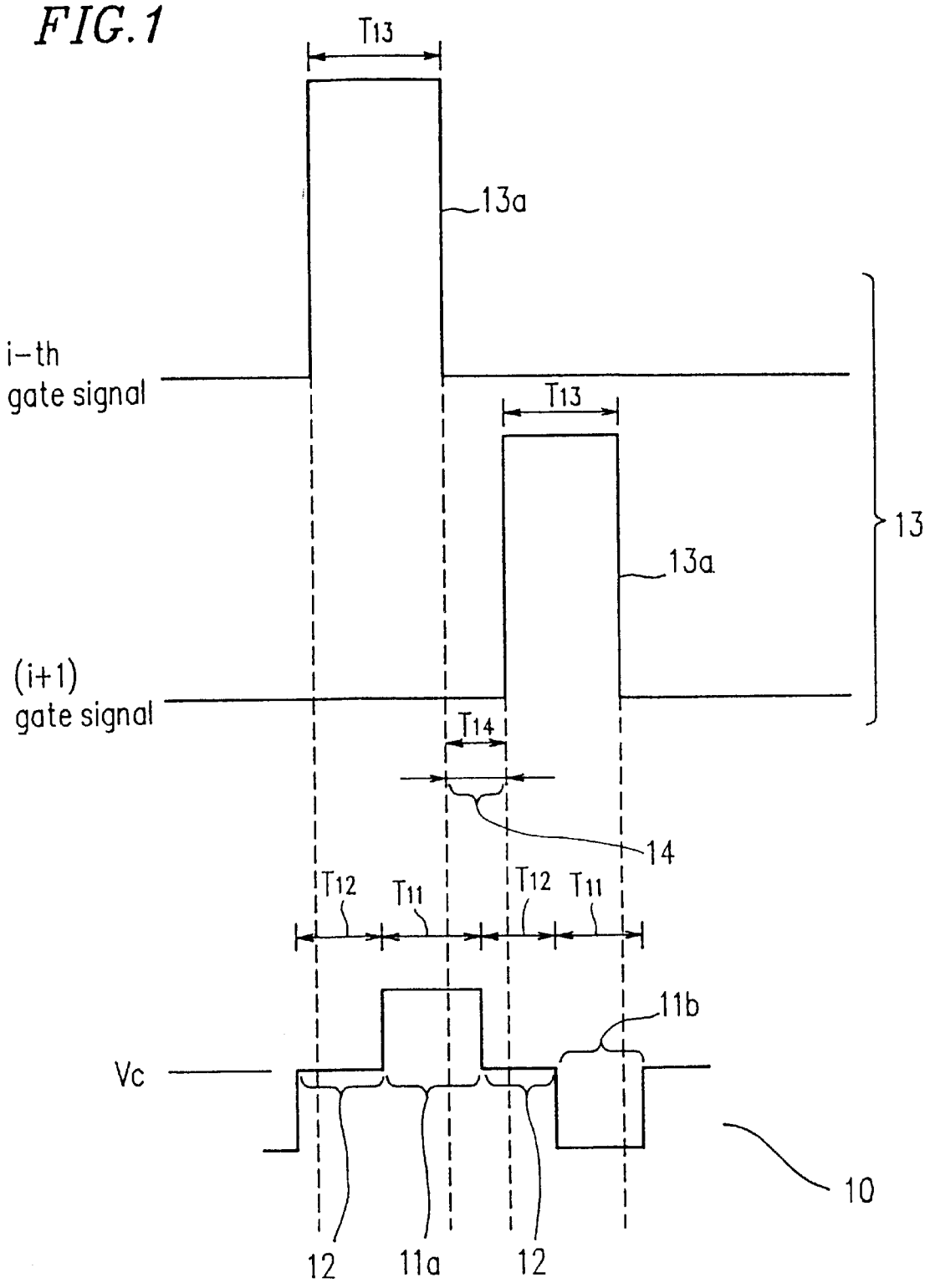
FIG. 1 is a view showing waveforms of a data signal and gate signals, for describing a method for driving an active matrix liquid crystal display device according to the present invention.

First, a basic principle of the present invention will be described with respect to the structure and effect thereof in comparison with the prior art.

According to the present invention, a data signal is applied, as an input signal, to the data line connected to the pixel electrode via the TFT. The data signal includes an image signal portion which defines a voltage level of an image display and a non-image signal portion which does not define any voltage level of an image display. The ratio of a period of the image signal portion included in the data signal with respect to one scanning period (i.e., an on-pulse period) of the scanning signal is set to approximately 80% or less.

Alternatively, the ratio of a period of the image signal portion included in the data signal with respect to one scanning period (i.e., an on-pulse period) of the scanning signal is preferably set to approximately 50% or less. In other words, it is preferable that, during an on-pulse period of the scanning signal, a period of the image signal portion of the data signal is shorter than that of the non-image signal portion of the data signal.

To shorten a period of the image signal portion of the data signal within an on-pulse period of the scanning signal leads to the effective reduction of the voltage applied to the TFT which is connected to the data line and the pixel electrode.

Japanese Laid-Open Patent Publication No. 60-59389 mentioned above discloses a driver circuit for the purpose of reducing power consumption on the data lines. An electrical switch is provided with the driver circuit at an output end, instead of a resistance, for discharging charges which have been provided to a load. Prior to outputting the data signal to the load, the electrical switch is turned on. As a result, the output end of the driver circuit is connected to a predetermined discharge potential so as to discharge the load until the voltage level of the load reaches a predetermined voltage level.

Thus, when the data line is driven by the driver circuit with the above configuration, a voltage level other than that of the image signal portion resultantly appears on the data lines. However, the above disclosed technique is for the purpose of discharging charges in the load by a required minimum amount during a short period of time by means of the electrical switch. Thus, the period in which the voltage level other than that of the image signal portion appears on the data lines is very short.

In the above technique, the period of a non-image signal portion which does not define any voltage level of image display is very short, unlike the present invention in which the ratio of the period of a non-image signal portion in the data signal with respect to an on-pulse period of the scanning signal is set to approximately 20% or more. Accordingly, the above technique is not useful for effectively reducing the voltage applied to the TFT which is connected to the data line and the pixel electrode.

Japanese Patent Publication No. 5-13320 discloses a method for driving a liquid crystal display device having a plurality of pixel electrodes arranged in a matrix and a plurality of switching elements composed of nonlinear elements connected between the pixel electrodes and data lines or timing lines. In this method, each frame period of a data signal input to the data lines has a suspension time in which the level of the data signal is constant. With this arrangement, the minimum effective value of the data signal in one frame is enhanced and the maximum effective value of the data signal in one frame is reduced. Thus, the variation in the effective value of a display pattern, i.e., display variation, can be minimized.

According to the above method for driving a liquid crystal photoelectric device, the voltage to be applied to the switching elements may be reduced due to the suspension time. However, since the suspension time is provided for each frame, the effect of reducing the voltage applied to the switching elements does not cover all the switching elements, unlike the present invention in which the period of the non-image signal portion which does not define any voltage level of image display is provided every scanning period. Thus, the above conventional method is not useful for effectively reducing the voltage applied to the TFTs.

The above conventional method for driving a liquid crystal photoelectric device uses switching elements composed of two-terminal nonlinear elements, and aims at improving the display quality by minimizing the variation in the effective value of a display pattern among frames. On the other hand, a method according to the present invention uses TFTs as the switching elements. The present invention solves the a problem of the leak current when the TFTs have a high mobility and a problem of reduced reliability of the TFTs due to the reduction of the size of the TFTs and the thinning of the gate insulating film, by reducing the voltage applied to the TFTs as the switching elements. The two methods are therefore distinctly different from each other with respect to the structure and effect thereof.

Hereinafter, an example of the method according to the present invention will be described.

Figure 4:
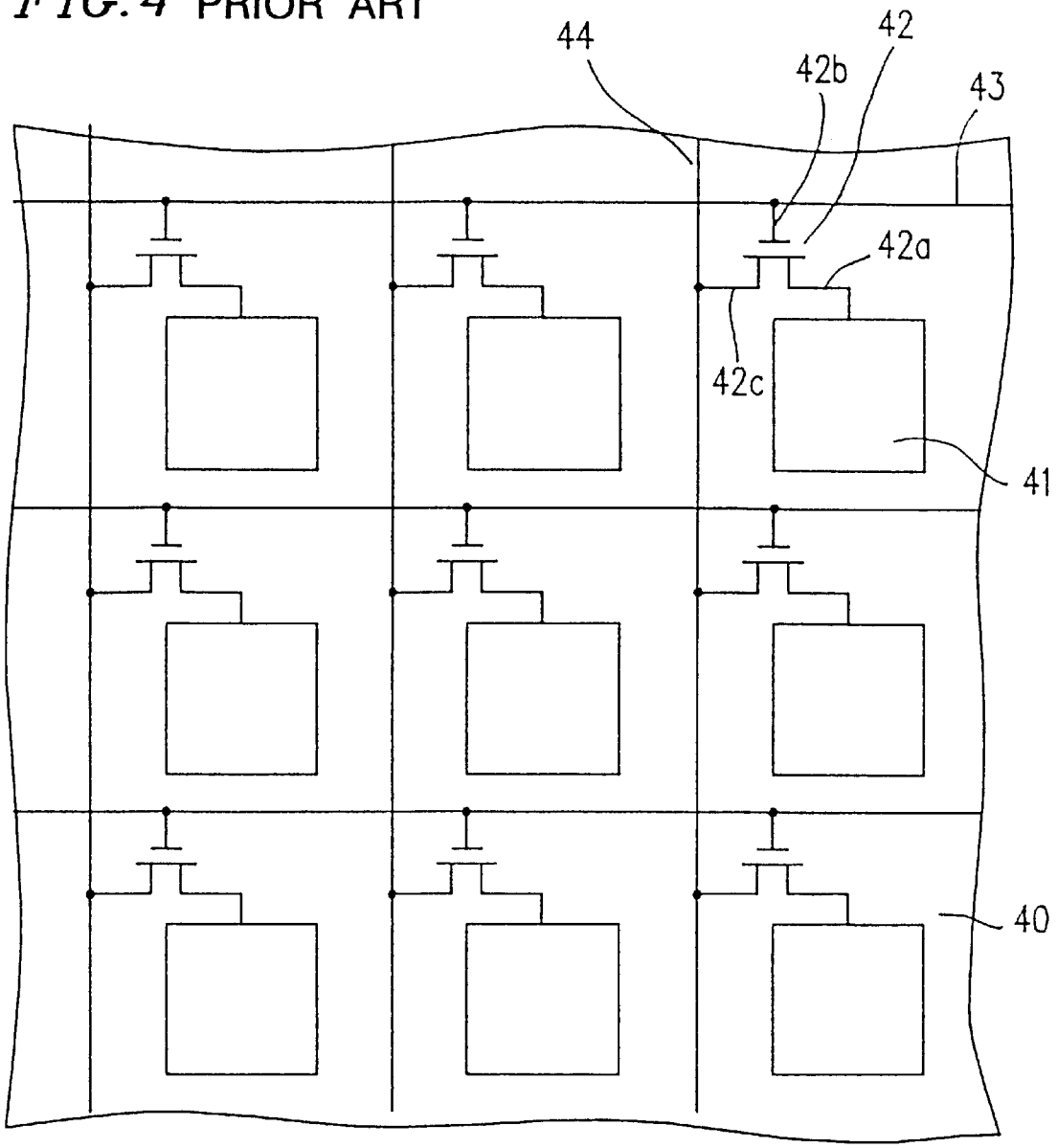
FIG. 4 PRIOR ART
FIG. 4 is a plan view showing a configuration of an image display section of a conventional active matrix liquid crystal display device, which is also used for the method according to the present invention.
Figure 5:
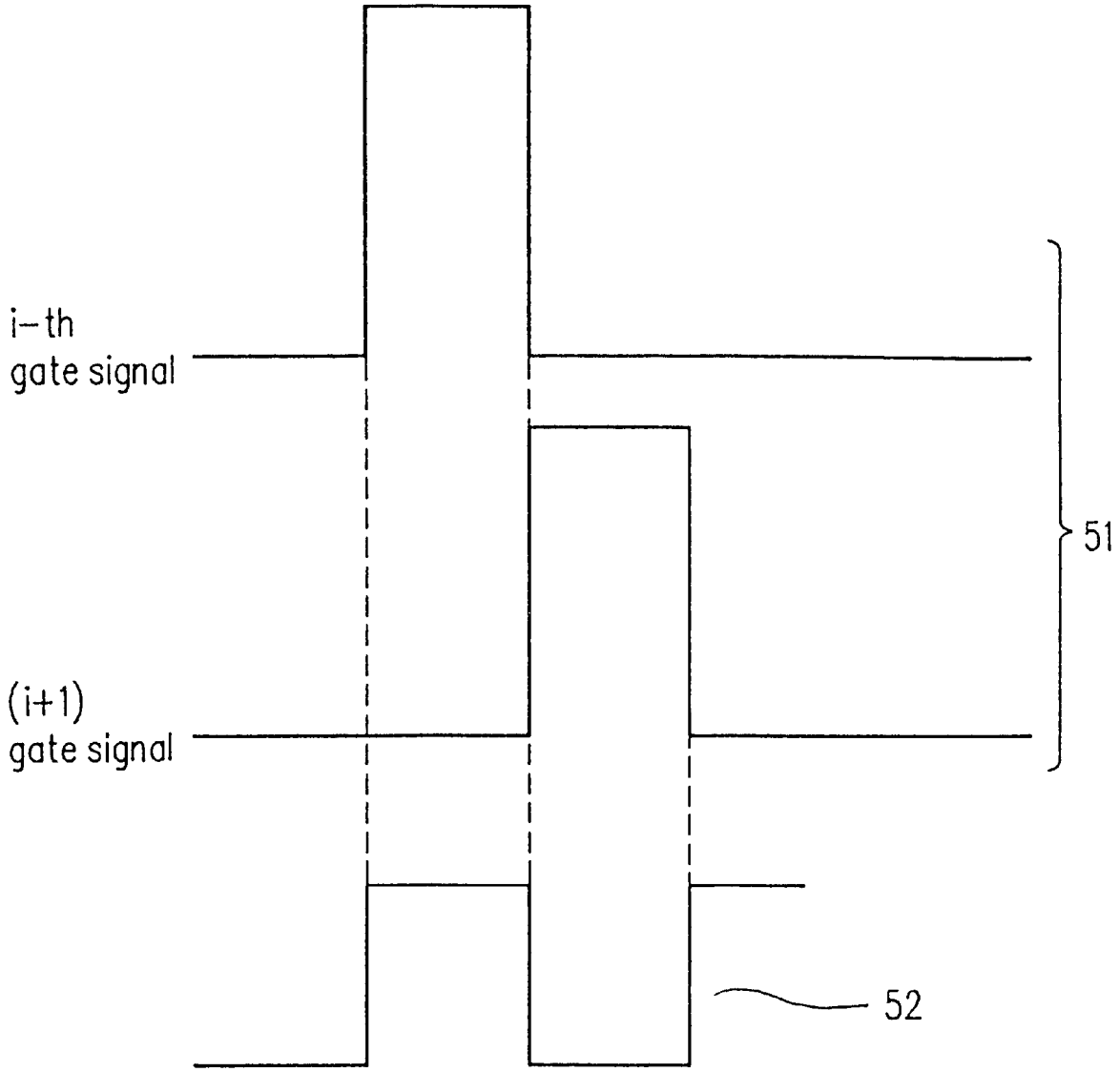
FIG. 5 PRIOR ART
FIG. 5 is a view showing waveforms of a data signal and gate signals, for describing the conventional method for driving a liquid crystal display device.
Figure 6:
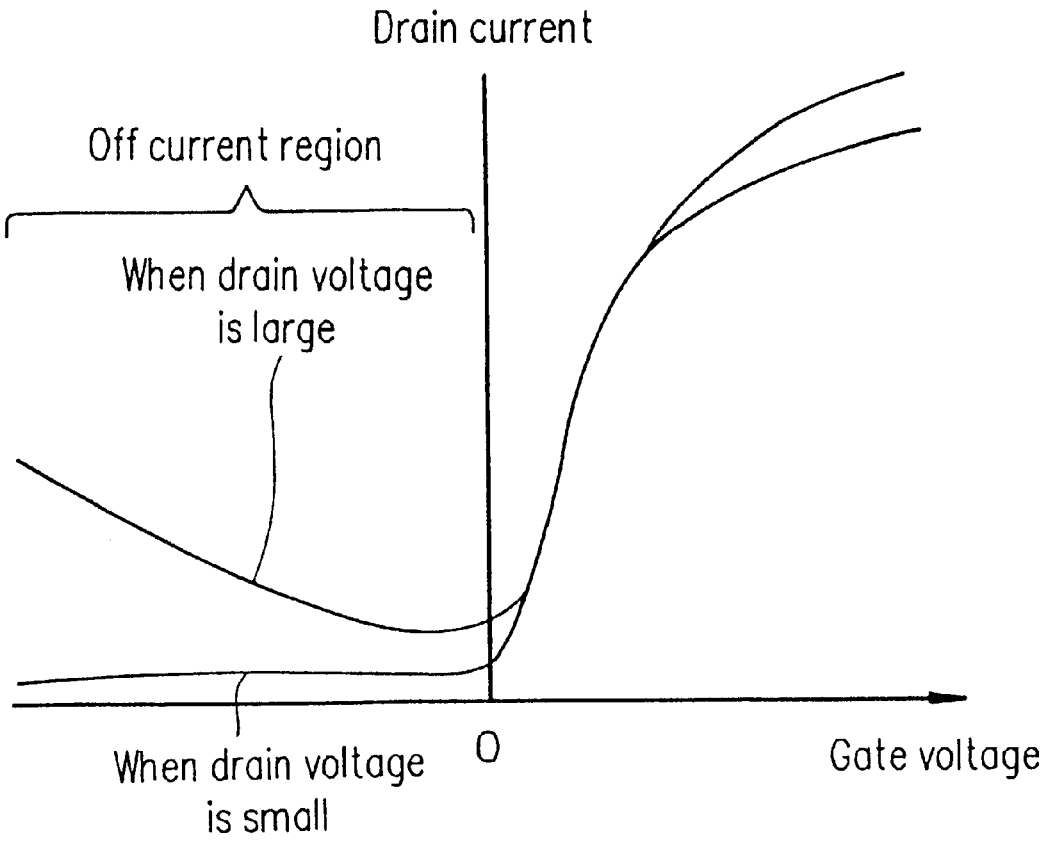
FIG. 6 PRIOR ART
FIG. 6 is a graph showing the characteristics of TFTs included in the image display section of the liquid crystal display device.

FIG. 1 shows waveforms of signals applied to the data lines and the gate lines, together with the rising and falling timings of the signals. Referring to FIG. 1, a method for driving an active matrix liquid crystal display device according to the present invention will be described. The liquid crystal display device used in this example has the same configuration as that of the conventional device shown in FIG. 4. In this example, the liquid crystal display device uses TFTs having a mobility of 1 $cm^2/V\cdot S$ or more, and preferably 10 $cm^2/V\cdot S$ or more, as a switching element. Also, the liquid crystal display device may use a TFT including a semiconductor layer made of polysilicon or microcrystalline silicon.

In FIG. 1, the reference numeral 10 denotes a data signal to be supplied to the data lines 44. The data signal 10 includes image signal portions 11*a* and 11*b* which define voltage levels of an image display and non-image signal portions 12 which do not define any voltage levels of an image display. A period corresponding to the image signal portions 11*a* and 11*b* is referred to as a period $T_{11}$. A period corresponding to the non-image signal portions 12 is referred to as a period $T_{12}$.

During the period $T_{12}$, the non-image signal portion 12 has a constant value. The constant value is a mean value of the maximum and minimum values of the image signal portions 11*a* and 11*b* during the periods $T_{11}$. The mean value is equal to a DC level of an AC voltage applied to the data lines 44 in a case where the liquid crystal display device is driven by way of using an AC voltage as image data.

In this example, the ratio of the period $T_{11}$ corresponding to the image signal portions 11*a* and 11*b* to the period $T_{12}$ corresponding to the non-image signal portions 12 ($T_{11}$:$T_{12}$) is approximately 1:1. Thus, the relative duration of the image signal portions 11*a* and 11*b* in the data signal 10 is 50%. As this percentage is decreased, the voltage applied between the source and drain of the TFT is lower and thus the above-described prior art problems can be more effectively solved. Accordingly, in a case where the capability of flowing a current at the ON state of the TFT is higher and the time required for charging image data into the load is shorter, the relative duration of the image signal portions 11*a* and 11*b* in the data signal 10 expressed by $T_{11}/(T_{11}+T_{12})$ is preferably set at less than 50%. Thus, the relative duration of the image signal portions 11*a* and 11*b* in the data signal 10 is not limited to 50%.

The reference numeral 13 denotes gate signals applied to the gate lines 43. Each of the gate signals 13 includes a periodical ON pulse 13*a* during which the TFTs 42 are turned on. A period $T_{13}$ corresponding to the ON pulse 13*a* overlaps the period $T_{11}$ corresponding to the image signal portions 11*a* and 11*b* of the data signal 10. Such a overlap between the period $T_{13}$ and the period $T_{11}$ is provided so that the ratio of the period $T_{11}$ to the period $T_{13}$ is approximately 80% or less. It is preferable that the overlap is provided so that the ratio of the period $T_{11}$ to the period $T_{13}$ is approximately 50% or less.

A temporal gap 14 is provided between the ON pulse 13*a* of the gate signal applied to the i-th gate line and the ON pulse 13*a* of the gate signal applied to the (i+1)th gate line in consideration of a delay of the signal carried by the gate line. In this example, the period $T_{13}$ corresponding to the ON pulse 13*a* is set at 7 $\mu$S, while a period $T_{14}$ corresponding to the temporal gap 14 between the ON pulses 13*a* of adjacent gate lines is set at 4 $\mu$S. The time setting is not limited to the above values, but can be optimally determined in consideration of the display capacity of the image display device and the performance of the TFTs. However, the period $T_{14}$ of the temporal gap 14 between the ON pulses 13*a* should be at least 1 $\mu$S.

Figure 2:
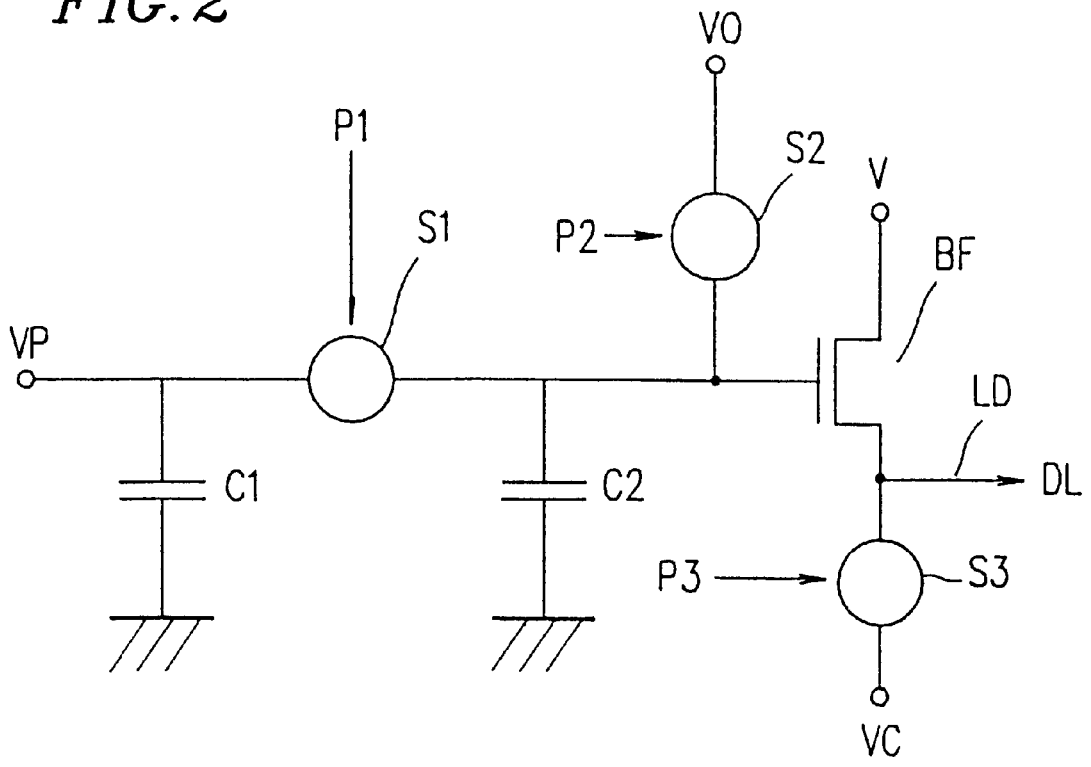
FIG. 2 is a circuit diagram showing a configuration of a data driver for generating the data signal of FIG. 1.

FIG. 2 shows a configuration of a part of a data driver for generating the data signal 10 shown in FIG. 1. More particularly, FIG. 2 shows a circuit configuration of the output end of the data driver corresponding to one data line (load).

Referring to FIG. 2, a sampling capacitor C1 is connected between an input node of image data VP and the ground for storing the image data VP. The sampling capacitor C1 is also connected to one end of a hold capacitor C2 via a switch S1. The hold capacitor C2 is also connected to the gate of a transistor constituting an output buffer BF. The input end of the output buffer BF (the gate of the transistor) is also connected to a constant voltage V0 via a switch S2, while the output end of the output buffer BF (the source of the transistor) is connected to a constant voltage VC via a switch S3.

The output buffer BF is configured to output an output signal which has the same level as that of an input signal thereof. The switch S2 is controlled by a control signal P2 so as to control the ON/OFF state of the output buffer BF. The constant voltage V0 is set at a voltage with which the output buffer BF is turned to the OFF state. The switch S3 is controlled by a control signal P3 so as to allow the voltage of a data line DL to be equal to the constant voltage VC when the output buffer BF is in the ON state. The value of the constant voltage VC is set at the mean value of the maximum and minimum values of the image data VP. The other end of the hold capacitor C2 is grounded. The drain of the transistor constituting the output buffer BF is connected to a power supply V.

In the driver having the output end with the above configuration, the image data VP stored in the sampling capacitor C1 is transferred into the hold capacitor C2 via the switch S1 according to the control signal P1, and is output to the data line LD through the output buffer BF. At this time, the switches S2 and S3 are switched on/off according to the respective control signals P2 and P3.

Figures 3A, 3B, 3C:
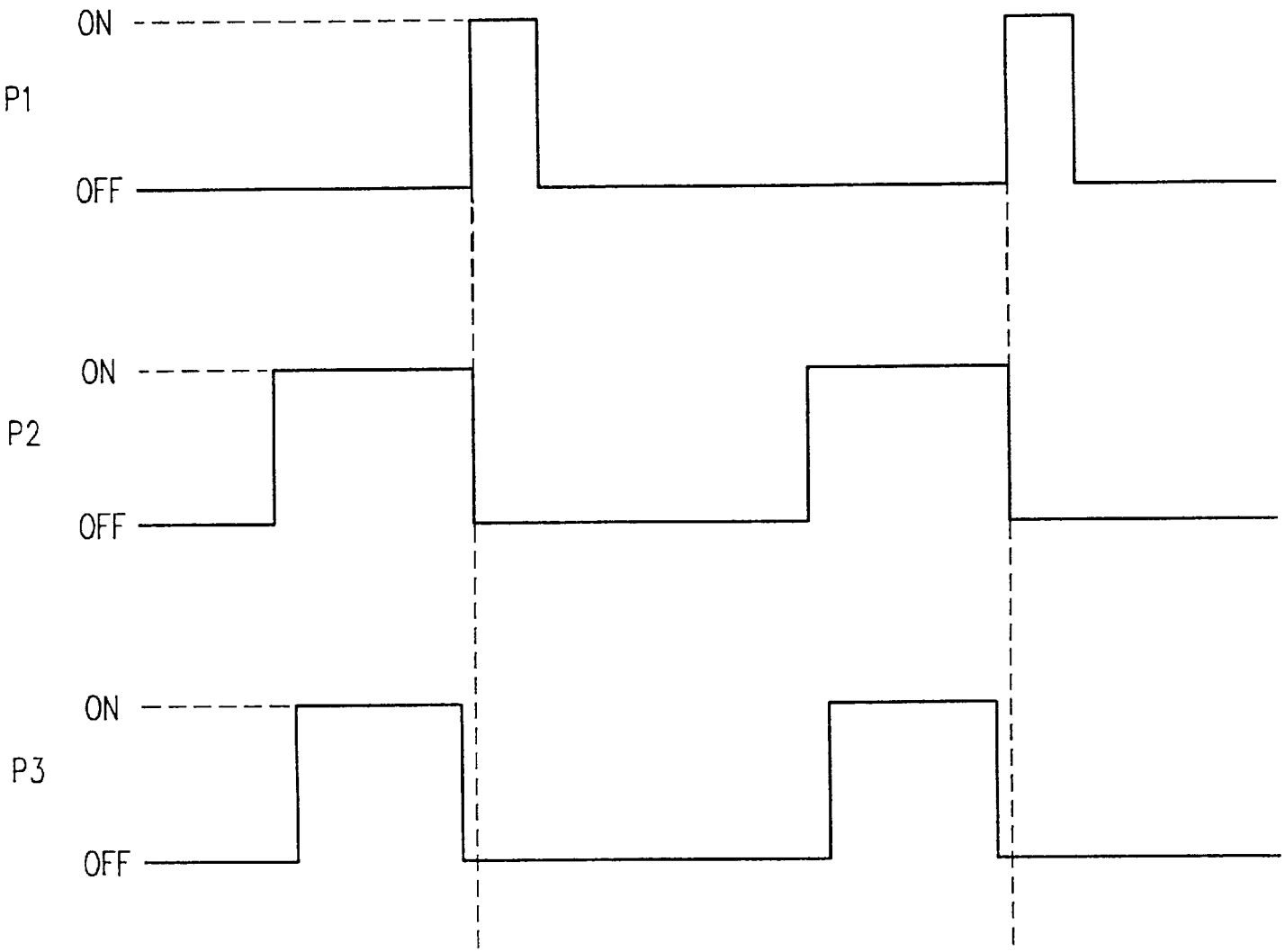
FIGS. 3A, 3B and 3C are views showing waveforms of control signals for controlling an output section of the data driver of FIG. 2.

FIGS. 3A, 3B, and 3C show the timings of the control signals P1, P2, and P3 shown in FIG. 2. As shown in FIGS. 3A, 3B and 3C, before the control signal P1 changes from the OFF level to the ON level so as to initiate the transfer of the image data VP from the sampling capacitor C1 to the hold capacitor C2, the control signal P2 changes from the OFF level to the ON level so as to turn the output buffer BF to the OFF state. Then, the control signal P3 changes from the OFF level to the ON level to set the voltage of the data line DL at the constant voltage VC. After the control signal P3 changes to the OFF level again, the control signal P2 also changes to the OFF level, and simultaneously the control signal P1 changes to the ON level. Thus, the data line DL obtains the same signal level as the image data VP.

The timings of the control signals P1 to P3 shown in FIGS. 3A, 3B and 3C define the period $T_{11}$ corresponding to the image signal portions 11*a* and 11*b* and the period $T_{12}$ corresponding to the non-image signal portions 12 in the data signal 10 shown in FIG. 1. Specifically, the period $T_{11}$ corresponding to the image signal portions 11*a* and 11*b* in the data signal 10 substantially corresponds to the period when the control signal P3 is at the OFF level, whereas the period $T_{12}$ corresponding to the non-image signal portions 12 in the data signal 10 substantially corresponds to the period when the control signal P3 is at the ON level. During the period $T_{12}$, the signal level of the data signal 10 is kept at the constant voltage VC.

By adjusting the timings of the control signals P1 to P3 shown in FIGS. 3A, 3B and 3C, the period $T_{11}$, $T_{12}$ and $T_{13}$ having the desired overlap relationship described above can be obtained.

Thus, by using a circuit as shown in FIGS. 3A, 3B and 3C, the data signal 10 is applied, as an input signal, to the data lines 44 which are connected to the pixel electrodes 41 via the TFTs 42. The period $T_{11}$ corresponding to the image signal portions 11*a* and 11*b* in the data signal 10 occupies approximately 50% or less in the on-pulse period $T_{13}$ of the gate signal 13. Accordingly, the effective value of the voltage applied between the source 42*c* and the drain 42*a* of the TFT 42 which is connected between the pixel electrode 41 and the data line 44 can be reduced.

As a result, even when the TFT 42 is made of a semiconductor material having a larger mobility than amorphous silicon, such as polysilicon, the increase of the OFF current of the TFT 42 can be restrained. Thus, while restraining the increase of the OFF current of the TFT 42, a speed for charging the load can be improved due to the increase of the ON current of the TFT 42.

Further, the strength of the electric field applied to the TFT 42 is substantially reduced. Thus, while the intrusion of carriers into the gate insulating film and the resultant insulation breakdown are minimized, the gate length of the TFT 42 can be reduced and the gate insulating film can be thinned.

Moreover, due to the substantial reduction of the voltage applied to the TFT 42, the disorder of the orientation of liquid crystal molecules at the edge portions of the pixel electrodes 41 caused by a potential difference between the bus lines (such as the gate lines 43 and the source lines 44) and the pixel electrodes 41 can be minimized. This improves the display characteristics of the liquid crystal display device and ensures long-term reliability.

Since the relative duration of the image signal portions 11*a* and 11*b* in the data signal 10 is approximately 50% or less, the ON time of the output buffer is substantially shortened. This improves the reliability of the output buffer.

The level of the non-image signal portions 12 of the data signal 10 is held at substantially a mean value of the maximum and minimum values of the AC driven image signal level. Accordingly, the voltage applied to the TFTs can be reduced while the variation in the voltage is minimized.

The circuit configuration of the data driver and the timing chart of the control signals are not limited to those in the above example described in FIGS. 2 and 3A, 3B and 3C. For example, an operational amplifier may be used in place of the output buffer in FIG. 2. In the latter case, the same effect as that described in the above example can be obtained.

A liquid crystal material having a photoelectric characteristics of a saturated voltage of 4 V or less, and preferably 3 V or less and capable of being driven at a low voltage, may be used for the liquid crystal display device. By using such a liquid crystal material, the orientation of the liquid crystal molecules changes by the application of a low voltage. Thus, in this case, degradation of the contrast of liquid crystal display which may arise by lowering the voltage applied to the TFT can be minimized.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A method for driving a display apparatus including a plurality of pixel electrodes; a plurality of thin film transistors each connected to a corresponding pixel electrode, a plurality of gate lines for applying a gate signal to the corresponding pixel electrode; and a plurality of data lines for applying a data signal to the corresponding pixel electrode via the thin film transistor, the method comprising the steps of:

applying a gate signal to the gate line, the gate signal including an on-pulse to switch a corresponding thin film transistor and said on-pulse defines a period during which the corresponding thin film transistor is turned on; and applying a data signal to the data line, wherein, during the on-pulse, the data signal includes an image signal portion which defines a voltage level of an image display, wherein a ratio of a period of the image signal portion of the data signal to the period of the on-pulse of the gate signal is equal to or less than approximately 80% and greater than 0%.

2. A method according to claim 1, wherein there is a temporal gap between the on-pulse applied to the gate line and a subsequent on-pulse applied to another gate line adjacent to the gate line, and the temporal gap is at least 1 $\mu$S.

3. A method according to claim 1, wherein the thin film transistor has a mobility of 1 $cm^2/V{\cdot}S$ or more.

4. A method according to claim 1, wherein the thin film transistor includes a semiconductor layer which is made of polysilicon or micro-crystalline silicon.

5. A method according to claim 1, wherein the display apparatus includes a liquid crystal layer having a saturated voltage of 4 V or less as photoelectric characteristics of the liquid crystal layer.

6. A method for driving a display apparatus including a plurality of pixel electrodes; a plurality of thin film transistors each connected to a corresponding pixel electrode, a plurality of gate lines for applying a gate signal to the corresponding pixel electrode; and a plurality of data lines for applying a data signal to the corresponding pixel electrode via the thin film transistor, the method comprising the steps of:

applying a gate signal to the gate line, the gate signal including an on-pulse which defines a period during which the corresponding thin film transistor is turned on; and applying a data signal to the data line, wherein, during the on-pulse, the data signal includes an image signal portion which defines a voltage level of an image display, wherein a ratio of a period of the image signal portion of the data signal to a period of the on-pulse of the gate signal is set to approximately 80% or less, wherein the on-pulse of the gate signal is changed from an on-level to an off-level during the period of the image signal portion of the data signal, the image signal portion of the data signal has a voltage level for an image display during a first period prior to the timing of changing from an on-level to an off-level of the on-pulse of the gate signal, and a non-image signal portion of the data signal has a constant value during a second period prior to the first period.

7. A method according to claim 6, wherein the constant value of the non-image signal portion is a mean value between a minimum value and a maximum value of the image signal portion.

8. A method for driving a display apparatus including a plurality of pixel electrodes; a plurality of thin film transistors each connected to a corresponding pixel electrode, a plurality of gate lines for applying a gate signal to the corresponding pixel electrode; and a plurality of data lines for applying a data signal to the corresponding pixel electrode via the thin film transistor, the method comprising the steps of:

applying a gate signal to the gate line, the gate signal including an on-pulse which turns on a corresponding thin film transistor, and defines a period during which the corresponding thin film transistor is turned on; and applying a data signal to the data line, wherein, during the on-pulse, the data signal includes an image signal portion which defines a voltage level of an image display and a non-image signal portion which does not define a voltage level of an image display, wherein, during a period of the on-pulse of the gate signal, a period of the image signal portion of the data signal is shorter than that of the non-image signal portion of the data signal.

9. A method according to claim 8, wherein there is a temporal gap between the on-pulse applied to the gate line and a subsequent on-pulse applied to another gate line adjacent to the gate line, the temporal gap is at least 1 $\mu$S.

10. A method according to claim 8, wherein the thin film transistor has a mobility of 1 $cm^2/V{\cdot}S$ or more.

11. A method according to claim 8, wherein the thin film transistor includes a semiconductor layer which is made of polysilicon or micro-crystalline silicon.

12. A method according to claim 8, wherein the display apparatus includes a liquid crystal layer having a saturated voltage of 4 V or less as photoelectric characteristics of the liquid crystal layer.

13. A method for driving a display apparatus including a plurality of pixel electrodes; a plurality of thin film transistors each connected to a corresponding pixel electrode, a plurality of gate lines for applying a gate signal to the corresponding pixel electrode; and a plurality of data lines for applying a data signal to the corresponding pixel electrode via the thin film transistor, the method comprising the steps of:

applying a gate signal to the gate line, the gate signal including an on-pulse which defines a period during which the corresponding thin film transistor is turned on; and applying a data signal to the data line, wherein, during the on-pulse the data signal includes an image signal portion which defines a voltage level of an image display and a non-image signal portion which does not define a voltage level of an image display, wherein, during a period of the on-pulse of the gate signal, a period of the image signal portion of the data signal is shorter than that of the non-image signal portion of the data signal, wherein the on-pulse of the gate signal is changed from an on-level to an off-level during the period of the image signal portion of the data signal, the image signal portion of the data signal has a voltage level for an image display during a first period prior to the timing of changing from an on-level to an off-level of the on-pulse of the gate signal, and a non-image signal portion of the data signal has a constant value during a second period prior to the first period.

14. A method according to claim 13, wherein the constant value of the non-image signal portion is a mean value between a minimum value and a maximum value of the image signal portion.

* * * * *